United States Patent [19]

Natale

[11] Patent Number: 4,846,416

[45] Date of Patent: Jul. 11, 1989

[54] SLITTING AND WINDING MACHINE FOR TAPES

[75] Inventor: Guzzetti Natale, Turate, Italy

[73] Assignee: Meccanica Comasca S.R.L., Italy

[21] Appl. No.: 154,348

[22] PCT Filed: May 7, 1987

[86] PCT No.: PCT/IT87/00041

§ 371 Date: Jan. 4, 1988

§ 102(e) Date: Jan. 4, 1988

[87] PCT Pub. No.: WO87/06919

PCT Pub. Date: Nov. 19, 1987

[30] Foreign Application Priority Data

May 9, 1986 [IT] Italy ..... 20387 A/86

[51] Int. Cl.[4] ..... B65H 19/20

[52] U.S. Cl. ..... 242/56 A; 242/56.9; 242/81

[58] Field of Search ..... 242/56 A, 56.6, 64, 242/81

[56] References Cited

U.S. PATENT DOCUMENTS

| | | | |
|---|---|---|---|
| 2,970,786 | 2/1961 | Justus et al. | 242/56 A |
| 3,848,824 | 11/1974 | Van Schijndel | 242/56 A |
| 4,611,769 | 9/1986 | Orbach | 242/56 A |
| 4,715,552 | 12/1987 | Matsumoto | 242/56 A |

*Primary Examiner*—Stuart S. Levy
*Assistant Examiner*—Steven M. duBois
*Attorney, Agent, or Firm*—Ostrolenk, Faber, Gerb & Soffen

[57] ABSTRACT

A longitudinal cutting and rewinding machine for adhesive and non-adhesive tapes, in which, starting from a tape jumbo roll, the tape is cut into longitudinal strips of desired width and, using one or more rewinding turrets (TO) the strips are rewound automatically in desired lengths around cores. The machine includes a loading and unloading unit (CA). The tape is rewound automatically in variable lengths around cores (AN) having different external diameters.

17 Claims, 4 Drawing Sheets

SLITTING AND WINDING MACHINE FOR TAPES

BACKGROUND OF THE INVENTION

The present invention relates to the field of machines for cutting and rewinding adhesive and non-adhesive tapes of different sizes.

The present invention provides, in particular, a fully automatic machine, that longitudinally cuts tapes to desired widths and rewinds the longitudinally cut strips around cores having different external nominal diameters. The art includes a machine which includes a jumbo roll and an unwinding stand, separated from the machine itself. Using rollers of different diameters, the machine unwinds tape from the jumbo roll. The prior art machine automatically supplies the tape with one or more cross tabs made of paper or plastic film. The prior art machine then cuts the tape longitudinally in strips of predetermined widths by one of the three following cutting systems: a razor blade cutting device, a system for score cutting by means of a hardened cylinder and circular dinking dies, or circular blades and counter-blades. These cutting systems are well known.

According to the present invention, the tape strips are rewound around cores of desired external diameters. The tapes are cut when the rolls of rewound strips reach the desired length. Then the rolls are discharged into a basin.

Subsequently, rolls are discharged onto a suitable conveyor belt. The same station that discharges the rolls also carries out the loading of new cores.

An aim of the present invention is a machine of the above mentioned type, which is provided with one or more rewinding turrets. Each of these turrets is supplied with three stations as follows: a first station for rewinding previously cut tape strips, a second station for automatically cutting and fastening the cut end of the tape, and a third station for unloading rewound rolls and loading new cores. The three stations are angularly arranged 120 from each other.

The machine is operated by rotating one of the turrets. This turret is called the drive turret and is connected to a hydraulic cylinder/free wheel system. The hydraulic cylinder/free wheel system moves the drive turret. Through a group of gears joined in series, the other turrets are also driven with the drive turret so that all of the turrets are cylindrically operated through the three 120°-spaced positions.

In addition to the sequential movement through three 120°-steps, the rewinding station must be driven when it is in the rewinding position. This further driving of the rewinding station is performed by means of a further rewinding motor. The rotation speed of the rewinding motor is adjustable to accommodate the type of tape being rewound. Thus, each rewinding turret includes three shafts corresponding to the three stations. The shafts are rotatably driven by means of the rewinding motor and a toothed or belt (or gear) transmission. Using friction means, the rotation is transmitted to the core-holders. The rotation of the shafts is carried out by disengaging a clutch connected to the rewinding motor and the roll rotation drive shaft and operating an external belt (or spur gear) transmission driven by a second rewinding motor. This causes the rewinding shaft to rotate.

When the rewinding shaft is joined to the belt transmission (or gear series) through a pair of gears external to the turret, it transmits movement to a series of rewinding shafts. Expanding plastic material core-holders for supporting the cores are located on the shafts.

Each core-holder is driven, during the rewinding phase, by a tooth belt and pulley (or a series of gears). One of them is assembled as an idle element on the shaft and locked between a series of spacers introduced on the shaft and driven by the rewinding motor.

When these spacers are joined by friction with the pulley (or gear) they then rotate together with the pulley (or gear) and the rewinding shaft. The torque transmitted by the drive pulley (or gear) is a consequence of the friction produced between the pulley (or gear) and the spacers that lock the same. The spacers are pressed by two springs which are pressed by two corresponding opposite adjusting ring nuts at the two ends of the shaft. When the desired rewinding length is achieved, the turret rotates through 120° under the action of the hydraulic cylinder. Thus, rewound rolls are brought from the rewinding station to the cutting and automatic cut end fastening station.

According to another feature of the invention, each turret is provided with a cutting unit between the first rewinding station and the second cutting and automatic cut end fastening station. The cutting unit includes a blade assembled on a trolley or the like. Each turret is provided with an idle roller, this roller automatically sticks adhesive tape onto its own external surface thereby ensuring that the just cut tape end is retained. The idle roller also stretches the tape so that the adhesive tape can then be wound on a new core. Each rewinding turret includes three idle rollers. The rollers are assembled between the three stations. The rollers are equally spaced among the stations.

According to another feature, each rewinding turret includes a loading and unloading unit. This unit includes a puller. After a 120° rotation, the puller pulls a rewound roll and makes the roll fall into an underlying basin and introduces a new core onto the free core-holder.

The whole core loading/unloading unit is assembled on a mobile frame. The frame slides along fixed guides by means of sliding rollers. The sliding motion is driven by a hydraulic or pneumatic cylinder. The machine includes internal parts for holding conveyor belts for the ejection of finished rewound rolls. The mobile unit allows for easy inspection of these internal parts. That is, the mobile unit can be extracted away from the machine to facilitate inspection.

Further, the loading/unloading unit, during its return movement and after having introduced a new core onto a coreholder, causes trap doors of the basins to open. Thus, rewound rolls within the basin fall in tidy sequence into underlying conveyor belts. This movement is performed by hydraulic, pneumatic or electronic means.

Subsequently, after the return movement, the loading/unloading unit is fed through a series of channels that convey spaced cores. The cores were previously introduced into the channels by a feeder from a hopper.

The channels are sloped. Thus, when a core stop device is opened, a plurality of new cores will be drawn from the loading/unloading unit to be charged into the loading and unloading station of each of the various rewinding turrets.

Further, when the loading/unloading unit draws the cores, the presence of core-holders is sensed by means of an electric sensor. The sensor includes a metallic blade which is fixed to the loading/unloading unit and joined to an electric system. If a core is not present, the blade contacts the metallic core stop device and trips a switch to lock the loading and unloading unit.

The above mentioned features and objects of the invention will be understood more clearly after considering the following description of a preferred embodiment, as shown in the annexed drawings, in which:

DETAILED DESCRIPTION OF THE PREFERRED EMBODIMENT

Figure 1:
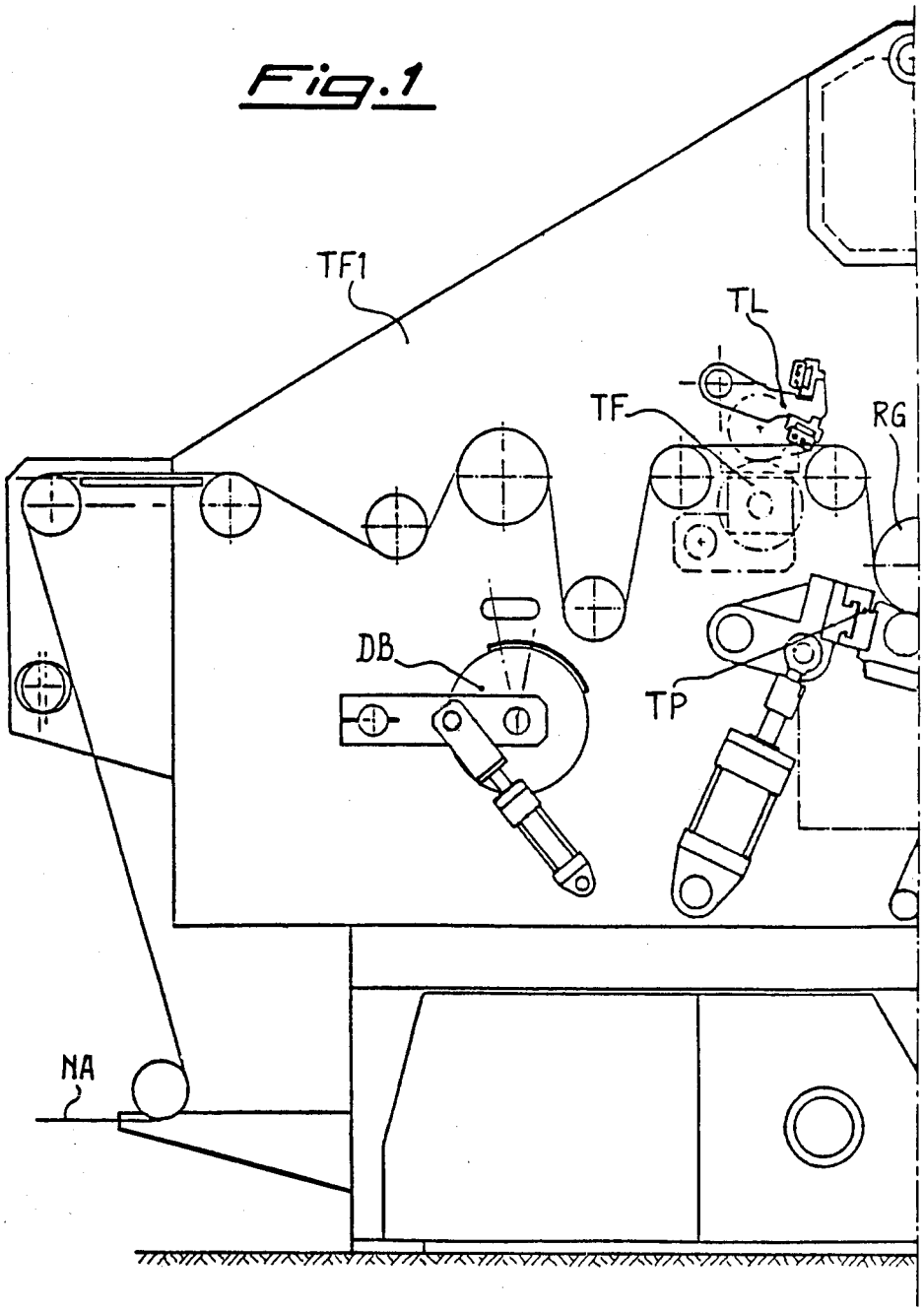
FIG. 1/1A shows a schematic view of the machine according to the invention.
Figure 1A:
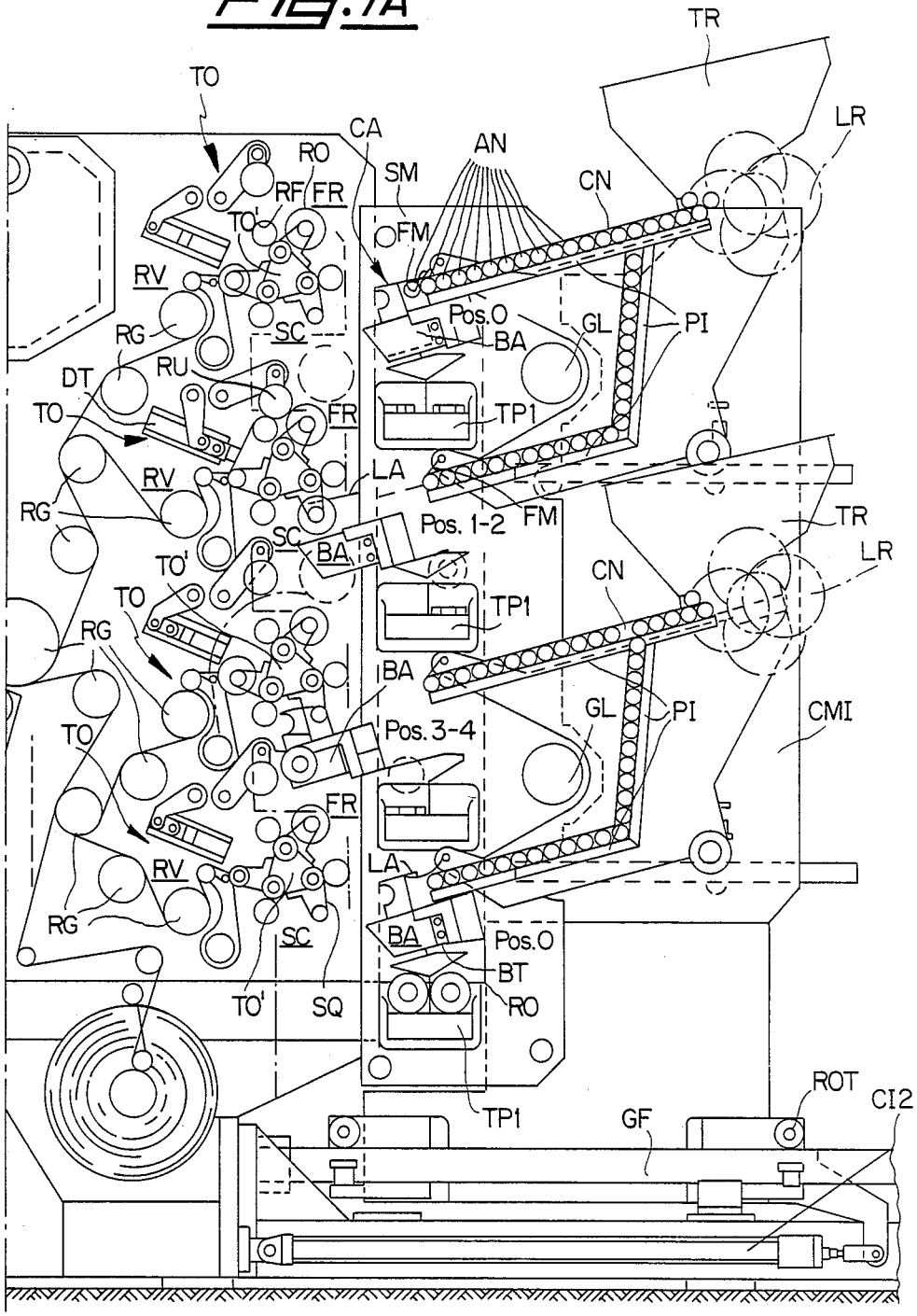

Referring to FIG. 1/1A, the machine structure includes a fixed frame TF1 made of two sheet plates connected by fixed elements. The various working stations, described below, are inside the fixed frame TF1.

A secondary frame CM1 allows for movement of certain parts as follows: a hopper TR holding cores AN, channels CN for guiding the cores AN, unloading rolls RO and a new core AN loading unit CA. The secondary frame CM1 can slide along guides GF by means of rollers ROT. The secondary frame CM1 is driven by a pneumatic or hydraulic cylinder CI2. The secondary frame CM1 supports a third frame SM. The third frame SM is laterally mobile by means of guides GL and is driven by pneumatic or hydraulic cylinders C1. The third frame SM is mobile toward the axis of the rewinding turrets TO by means of guides and is driven toward the axis by hydraulic or pneumatic cylinders CI.

Reference character NA (FIG. 1/1A) indicates the adhesive or non-adhesive tape, coming from a jumbo roll (not shown). The jumbo roll can reach a max. diameter of 1200 mm. The tape from the jumbo roll has a variable width. The tape coming from the jumbo roll crosses in a well known way an unwinding stand and rollers having different diameters. The tape then reaches an automatic device DB for the application of one or more cross tabs to separate the ends of the tape when it is cut. The tape then reaches the cutting unit which cuts the tape longitudinally into strips of desired widths by means of one of the three previously described cutting systems. The longitudinally cut tapes then cross a series of further guiding rollers RG (FIG. 1/1A) to reach the rewinding turrets TO (four are shown in this example).

Figure 2:
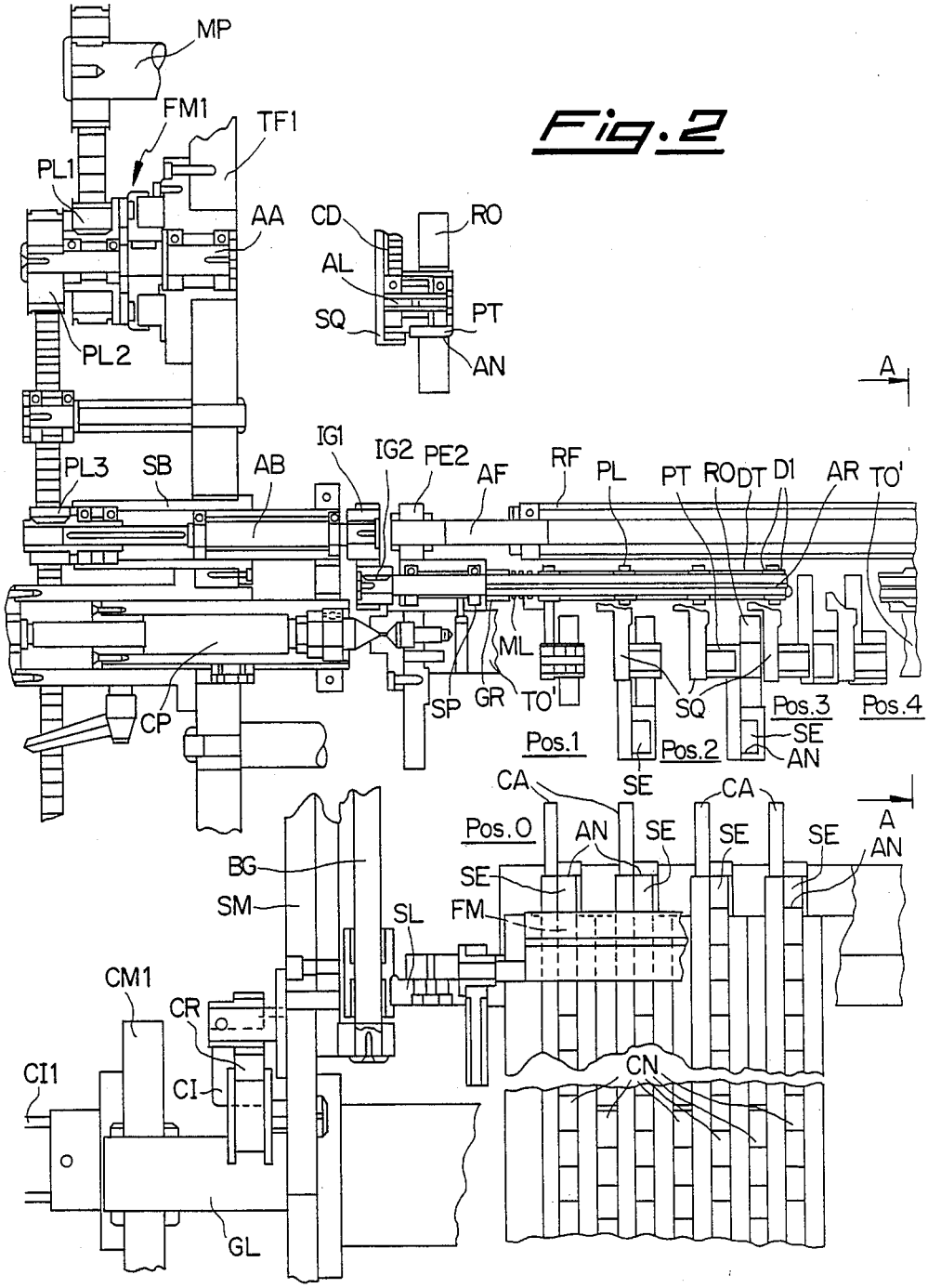
FIG. 2/2A shows one of the four rewinding turrets in detail and a loading and unloading unit.
Figure 2A:
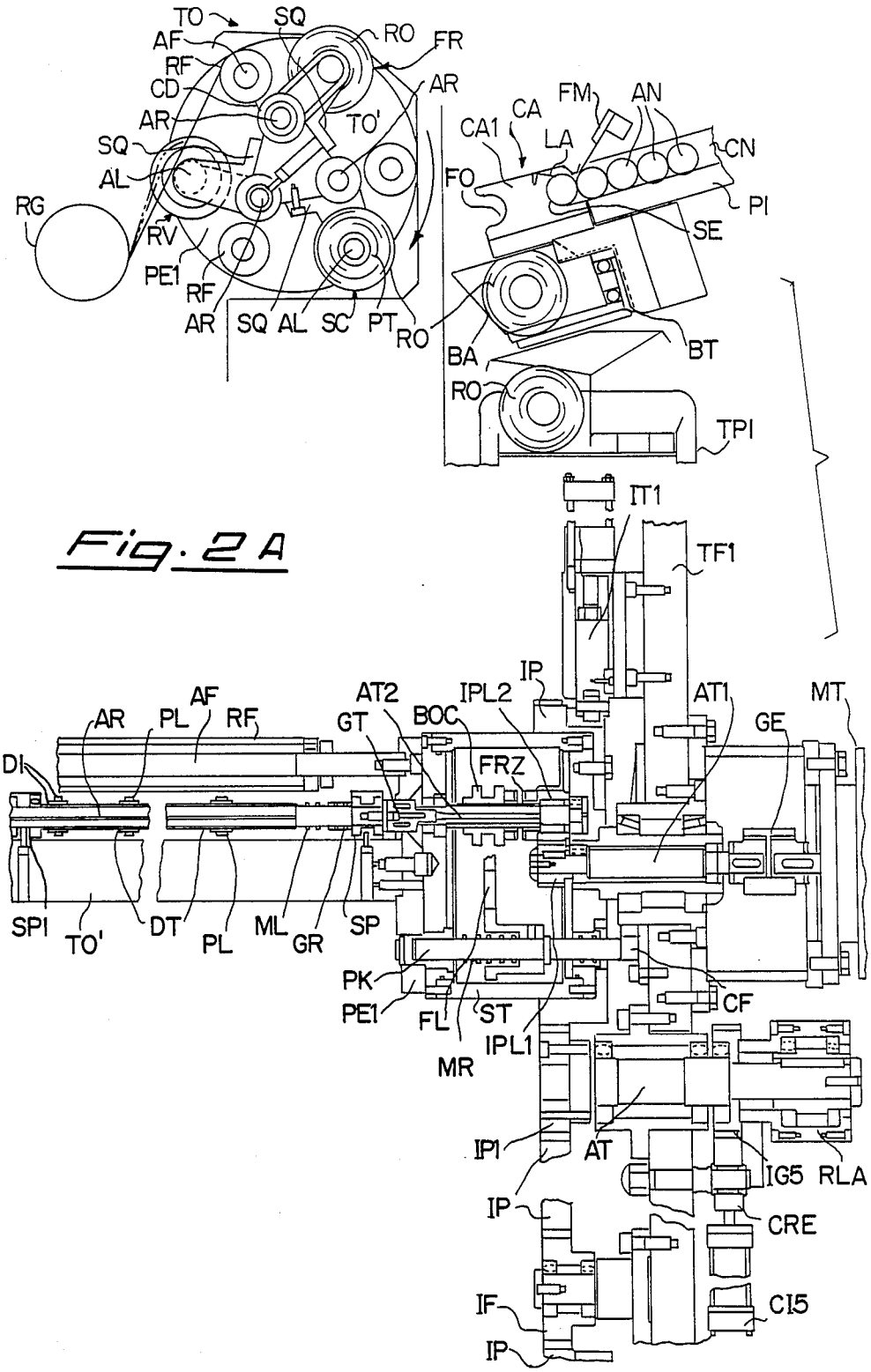

Referring now to FIG. 2/2A, a very important feature of the present invention is that the rewinding turret/turrets TO are made in a form that is quite identical to the spindle head and tailstock system present in lathes of the known art. Each one of the rewinding turrets TO is made up by two end plates PE1 and PE2. The end plates are joined at a central part by a prismatic piece TO' with an equilateral triangular structure, that is used as support for square rests SQ. The square rests SQ support pins AL of the rewinding core-holders PT. The two plates PE1 and PE2 support between themselves three fixed shafts AF that support three idle rollers RF, whose aim shall be also described in the following. The left end of the turret TO (FIG. 2/2A) foresees the end plate PE2 that is forced against the tailstock CP turning by bearings. This is well-known in the prior art of machine tools.

Each of the turrets TO has three stations for supporting core-holders PT: A first station RV at which the tape NA is rewound. A second station FR which is like the first station, but is shifted 120° respect to the first station. Cutting and automatic cut end fastening occurs at the second station. A third station SC is used for unloading rewound rolls and for loading new cores AN. The third station is shifted 120° from the second station.

One of the rewinding turrets, specifically, the drive turret, includes a transmission gearbox ST. The transmission gearbox is connected directly to the hydraulic cylinder CI5 that causes the rotation of the drive turret TO through 120°-steps. In detail, the hydraulic cylinder CI5 is fixed to fixed frame TF1 of the machine. The connection between the drive turret TO and the hydraulic cylinder CI5 is made through a rack fixed to the rod of cylinder CI5, that drives a gear IG5 connected directly to the free wheel RLA, keyed to the transmission shaft AT. The drive gear IP1 is keyed to the other end of the transmission shaft AT. This main drive gear IP1 transmits the 120°-rotation movement to the other rewinding turrets TO through the idle gears IF and other main gears IP. Each main gear IP also forms a wall of gearbox ST holding the primary gear IPL1 keyed to the shaft AT1. The shaft AT1 transmits rotation supplied from the rewinding motor MT to three secondary planetary gears IPL2. There is one planetary gear for each drive shaft AR.

The planetary gears IPL2 are keyed idle on the secondary shaft AT2 through a bearing and are also fixed to a first right half of a friction or electromagnetic clutch FRZ. The clutch FRZ allows for engagement or disengagement of the secondary gears IPL2 and the secondary shaft AT2. The clutch FRZ is disengaged by means of a fork FL acting on a cylindrical cam BOC sliding on the shaft AT2 and joined to the second left half of the clutch FRZ. The fork FL is controlled by a rod PK. The rod PK is operated externally of the gearbox ST by means of a circular cam CF. The cam CF is fastened to the fixed frame TF1 of the machine.

The 120° rotational movement of the transmission gear box ST, the drive turret TO and, thus, of all the turrets at the same time, is possible only when the clutch FRZ is engaged. In detail, this happens under the control of a photocell (not shown) that signals the end of the adhesive tape rewinding on a core AN. This photocell operates the hydraulic cylinder CI5, which turns the main gear IP and then drives the whole transmission gearbox ST causing the rod PK to advance by means of the cam CF. The cam CF is supplied with three depressions corresponding to the three 120°-positions. Then the rod PK, under the action of the recovery spring MR and the fork FL and cylindrical cam BOC and clutch FRZ connects the gear IPL2 and the gear IPL1. In this way, rewinding of a roll RO begins regardless of the position reached by the turret. The other end of the shaft AT2 has an elastic joint GT that connects the shaft AT1 with the rewinding shaft AR. The idle gears IP transmit rotation to the underlying turrets to synchronize the winding stations TO. There are four such stations in this example, but more can be provided. Each of the three shafts AR (FIG. 2/2A) is supported by three supports. These three supports include one central support SP1 and two lateral supports SP. The shaft AR is provided with an axially assembled series of parts made up alternatively of spacers DT and toothed pulleys (or drive gear) PL.

Disks D1, made of a wear resistant material, are interposed among the parts. Play caused by wear of these disks D1 is taken up by two end ring nuts GR. The pulleys (or gears) PL are assembled idle on the shaft AR. The central support SP1 of the shaft AR divides the series of spacers DT and toothed pulleys (or gears) PL in two halves and acts as a fixed central point against which the springs ML apply an axial thrust. This thrust is adjusted by the ring nuts GR. The ring nuts also allow for adjustment of the torque transmitted from shaft AR and the pulleys (or gears) PL. The two ring nuts GR are screwed onto threaded ends of the shaft AR. The ends of the shaft AR include a stop grub screw (not numbered) for preventing the unlocking of the ring nuts GR after their axial position has been adjusted. These grub screws engage a slot machined on the shaft AR. The grub screws are tightened so as to maintain the adjustment of the spring pressure. The series of square supports SQ are assembled on the central part TO' of the turrets TO. The square supports SQ support the fixed pins AL. The fixed pins AL rotatably support the core reels PT. The core reels PT are assembled on bearings. The core holders PT are made of plastic or other similar materials and are expandable to hold the cores AN in position.

Toothed belts (or gear couples) CD transmit movement from each pulley (or gear) PL to the pulley (or gear) assembled on the pin AL, so that torque transmitted is proportional to the pressure between the lateral surfaces of the spacers DT and the surfaces of the pulleys (or gears) PL, under the action of the springs ML. The rewinding shaft AR, in the left side, that is, the side opposite to the side in which the rewinding motor MT is keyed, is provided with a straight-tooth gear IG2 that meshes with a gear IG1 during the rewinding phase of the turret shaft AR. This gear IG1 is keyed to a rewinding control shaft AB. The toothed pulleys PL1-PL2-PL3-PL4 transmit rewinding movement from an adjustable speed motor (not shown) to the rewinding control shaft AB, through an adjustable electromagnetic joint FM. Obviously, when the rewinding motor MT is connected to the shaft AT2 by means of the clutch FRZ, the transmission made up of the gears IG1 and IG2 is not engaged at the same time, since the two movements are independent of each other. In fact, the rewinding motor MT rotates the expansible core-holders PT to stretch the adhesive tape strips. The motor MT also starts the rewinding process. The motor MT acts only when the clutch FRZ is engaged, this action goes on until the rewinding control motor is cut-in which acts only when one of the three gears IG2 meshes with the gear IG1. The gear IG1 is in a fixed position with respect to the position of the shaft AB. When the rewinding turret TO is rotated through 120°, the clutch FRZ is disengaged by the fork FL. The fork FL is operated by the fixed cam CF and the spring MR. This fork FL causes the gear IPL2 to be disengaged from the shaft AT2. Tapes are then rewound at the station RV. The three rewinding shafts AR of each of the turrets TO are all equally spaced with respect to the rotation axis of the turret TO. Since the positions of the support SB, the shaft AB and the gear IG1 are fixed, the gear IG2 of the shaft AB automatically meshes with the gear IG1, driven by the rewinding motor (not shown) and disengaging at the same time the rotation of the motor MT by means of the clutch FRZ. Disengagement of the clutch FRZ occurs only in this position owing to the control of the timing fixed cam CF. The main gear IP is provided with three recesses spaced at 120°-angles. The recesses act on the switch IT1 to precisely control the three different working phases of the hydraulic cylinder CI5, corresponding to the three desired 120° positions.

Further, this switch IT1 is also used for starting the rewinding cycle, employing pneumatic or hydraulic means. The switch IT1 is also used for unloading a finished roll RO and for loading a new core AN onto the final station SC. The gear IP rotates under the action of the hydraulic cylinder CI5, this action being started by a photocell, as above said, and the roll RO is transferred into the station FR. Here, the tape is cut by a blade (not shown). The blade falls onto the tape or slides laterally in a well-known manner. The idle roller RF retains the end of the adhesive tape NA until the new rewinding cycle starts (when a core AN is placed in the station RV). After the tape NA is cut, the rewound roll RO is brought to the station SC. The rewound roll RO is extracted from the core-holder PT at the station SC.

This extraction process shall be described in the following and forms an object of the invention. The three idle rollers RF are also joined to the plates PE1 and PE2 by means of a respective shaft AF and supported on bearings. When the adhesive tape NA is wound, these three idle rollers RF form a smooth pipe which temporarily adheres to the just cut tape NA. The rollers RF hold the tape on their external surface until the rewinding roll RV starts its rotation to rewind the tape NA. If the tape used in the machine of the present invention is non-adhesive, the rollers RF must be covered with bi-adhesive paper so that the non-adhesive tape adheres thereto. In this case, the rollers RF are supplied with a brake for temporarily locking the non-adhesive tape until other rollers (not shown) act on the core-holder PT, cooperating to rewind the non-adhesive tape.

According to another feature of the present invention, the four turrets TO are laterally supplied with a system for feeding cores AN. The feeding system includes two or more hoppers TR (FIG. 1/1A) in which a system of rotating blades LR acts to feed the cores AN into channels CN (FIG. 2/2A) at a predetermined spacing and in a position suitable for being charged to the loading and unloading unit CA.

According to another feature of the present invention, the channels CN (FIG. 2/2A) at the outlet of each hopper TR are divided for controlling the feeding of cores AN toward the four winding turrets TO. Bulkheads FM stop the continuous flow of cores AN, so that each of the core loading and unloading units CA are fed only one core AN at a time. A characteristic element of the loading and unloading unit CA is the fork part CA1. The fork part includes a cavity FO. The fork part CA1 is used as a means for unloading a finished roll RO and as a means for introducing new cores AN. After a predetermined length of the tape NA has been rewound onto a core AN, the rewinding turrets rotate through 120°. Thus, the rewinding stations RV are displaced to the final stations FR. The stations FR are transferred to the unloading and loading stations SC. The stations SC with cores AN to be rewound are brought to the rewinding station RV.

According to another feature of the present invention, at the end of a 120°-rotation of the rewinding turrets TO and during cross cutting in the station FR, a series of units CA are operated to discharge rewound rolls RO and to load new cores AN to be wound. This operation is performed as follows: The unit CA (assembed on the mobile shoulders SM) is displaced as a trolley downwardly along the sloped chute PI under the action of a first hydraulic cylinder CI passing from the start position (pos. 0) to the position SC of lateral engagement with the rewound rolls RO (Pos. 1). This movement of the unit CA is made by sliding the unit along sloped bar guides BG which are fixed on the mobile frame SM. Under the action of a second hydraulic cylinder CI1, the unit CA is displaced to the right along the axis of a rewound roll (pos.2) thus causing the rewound roll RO to be extracted from the core-holder PT. The roll RO is then discharged into the basin BA (placed under the trolley CA) by the fork CA1 with the cavity OF. After this, the hydraulic cylinder CI moves the mobile shoulders SM forward and then the unit CA is displaced to bring the new core to the axis of the core-holder PT (pos.3).

A further lateral movement to the left (opposite to the previously described movement), under the action of the cylinder CI1 against the mobile shoulders SM, brings the new core AN to the insertion position (pos. 4). The units CA, during the movement back to the start position (pos. 0), after having put the new cores to be wound on the core-holders PT, cause the traps BT of the basins BA to open whereby the rewound rolls fall tidily toward the outside of the machine. The conveyor belts TP1 collect the rewound rolls RO. When the units CA return to the start position (pos. 0), the bulkheads FM are opened automatically, allowing the appropriate number of cores AN to enter into the seat SE included in the units CA.

Referring now to FIG. 1/1A, the frame CM1 includes the mobile shoulders SM, the hopper TR support unit and the core loading channels CN. The frame CM1 is supported by fixed circular and horizontal guides GF and by rollers ROT. The frame is movable under the action of the hydraulic or pneumatic piston CI2 to be driven away from the working zone of the machine (including the various rewinding turrets TO). Thus, inspection of the turrets TO in cases of accidental entanglements of the tapes NA and cleaning and control of the conveyor belts TP1 is possible.

According to another feature of the present invention, a blade LA is assembled on each unloading and loading unit CA for determining whether a core AN is present in the seat SE. Each blade LA is connected to the machine's metallic structure and acts as a negative pole in a 24V direct current electric system. The bulkhead FM is insulated from the machine structure and acts as a positive pole.

If a core AN is accidentally incorrectly introduced into the seat SE, or if a core AN is broken, then the blade LA does not properly contact a core AN and remains in contact with the bulkhead FM. Thus, electric signals are sent to prevent the start of an unloading and new core AN loading cycle.

As the sizes of the cores AN can vary greatly, the system for feeding the cores AN (including the hoppers TR and the seats SE made on the roll unloading and core loading elements CA1, that receive the cores AN) can have different sizes.

The foregoing description is for purposes of example only and should not be construed as limiting. The invention can be used, for example in printing machines and for handling industrial objects, pens, paper, cloths or the like.

What is claimed is:

1. A machine for cutting and rewinding tape, said machine including:

a turret, said turret being rotatable through steps of 120°, said turret including an axis;

said turret including three shafts, said shafts being angularly arranged 120° from each other;

said turret including three stations, each of said stations having a fixed position, said stations including a first station for loading a new core and unloading a rewound core, a second station for rewinding tape onto a core, and a third station for cutting tape and fastening an end or tail to a rewound roll, said stations being angularly arranged 120° from each other, each of said shafts being movable to each of said stations; and said turret including a central prismatic longitudinal piece rotatably drivable through steps of 120° around said axis together with said shafts;

wherein said central piece supports three core reels angularly arranged 120° from each other, each of said core reels being rotatably connected to one of said shafts;

whereby, during rotation of said prismatic piece, each core reel is sequentially positioned at said first station, then said second station, then said third station, and then back to said first station;

said machine further including:

means for rotatably driving said central piece through said steps:

means for rotatably driving each of said shafts in said second station;

means for cutting tape and fastening an end or tail to a rewound roll in said third station; and means for discharging a rewound roll and for charging a new core onto one of said core reels.

2. A machine according to claim 1 wherein said turret includes three rotatable idle rollers angularly arranged 120° from each other around said central piece, each of said rollers being adapted to support tape between said second station and said third station, and means for rotating said rollers with said central piece and said shafts through steps of 120°.

3. A machine according to claim 2, further including a gear transmission, said transmission including a transmission gearbox, said gearbox including a wall, and wherein said central piece, said shafts and said idle rollers are supported by two lateral rotating plates, one of said plates being a drive plate, said drive plate being joined to said wall, said gearbox being rotatably drivable through said gear transmission.

4. A machine according to claim 3, wherein said transmission includes a rotatable locking device, said transmission includes a toothed wheel, said wheel includes recesses machined thereon, said recesses being angularly arranged 120° from each other, wherein said locking deice, after rotating through 120°, is engaged with said recesses.

5. A machine according to claim 4, including a second turret and means for rotatably driving said second turret, said means for rotatably driving said turrets including only a single drive unit, said drive unit including a hydraulic cylinder.

6. A machine according to claim 5, wherein said central piece supports said core reels by means of square supports, said machine further including a rotation pin for each of said core reels and a rotatable connection between each of said rotation pins and said shafts, said connections including a gear transmission or a toothed belt transmission.

7. A machine according to claim 6, wherein said shafts are adapted to transmit rotation to said connections by means of a clutch coupling.

8. A machine according to claim 7, further including adjustable thrust springs, and wherein said clutch coupling includes tubular spacers and said clutch coupling further includes a gear or pulley, said gear or pulley being assembed as an idle element to said shifts and friction pressed between said tubular spacers so as to rotate together with said shafts, said idle element being slidable along the axial direction of said shafts, said idle element being adapted to be pushed in said axial direction by said adjustable thrust springs.

9. A machine according to claim 1, wherein said means for driving said shafts includes three fixed front cams, an axial pin, a gear transmission, a transmission gearbox, a fork, a clutch coupling, and a motor, said motor being joined to one of said shaft by means of said gear transmisson and said clutch coupling, said clutch coupling being operable by said fork, said fork being drivable by said axial pin, said pin being driven by said transmission gearbox, said pin being cooperable with said three fixed front cams, said cams being angularly arranged 120° from each other.

10. A machine according to claim 1, wherein said cutting means is a cross cutting means, and said cross cutting means includes a cutting device in the form of a carriage supplied with a blade or other similar tool, said cutting device being positioned between said second station and said third station.

11. A machine according to claim 1, further including means for further rotating each of said shafts, said further rotating means being positioned in said third station, said further rotating means including a motor, an electromagnetic coupling, and a transmission.

12. A machine according to claim 1, wherein said machine further includes a conveyor belt, said discharging and charging means being movable in a rectilinear direction, said discharging and charging means being made up of a puller/loader, said puller/loader including a front part and a rear portion, said front part including a fork seat for laterally engaging and unloading a roll, said rear portion including a seat for receiving and loading a new core onto one of said core reels, said machine further including an underlying basin for collecting unloading rolls and for supplying said rolls to said conveyor belt, said conveyor belt running under said basin, said machine further including a core feeding device and a sloping feeding channel, said core feeding device being operable to feed said cores through said sloping feeding channel.

13. A machine according to claim 12, said basin including a trap door said trap door including an opening, wherein said machine further includes means for controlling the opening of said trap door during the return of said discharging and charging means to said initial start position whereby a roll in said basin can be directed to fall onto said conveyor belt.

14. A machine according to claim 13, wherein said discharging and charging means includes a core stop device, said core stop device being adapted to control the arrival of a new core into said seat.

15. A machine according to claim 14, said discharging and charging means including a control sensor for sensing the presence of a core in said seat, said control sensor being activatable by an electric system.

16. A method of cutting and rewinding tape using a machine which comprises:

a turret, said turret being rotatable through steps of 120°, said turret including an axis;

said turret including three shafts, said shafts being angularly arranged 120° from each other;

said turret including three stations, each of said stations having a fixed position, said stations including a first station for loading a new core and unloading a rewound core, a second station for rewinding tap onto a core, and a third station for cutting tape and fastening an end or tail to a rewound roll, said stations being angularly arranged 120° from each other, each of said shafts being movable to each of said stations; and said turret including a central prismatic longitudinal piece rotatably drivable through steps of 120° around said axis together with said shafts;

wherein said central piece supports three core reels angularly arranged 120° from each other, each of said core reels being rotatably connected to one of said shafts;

whereby, during rotation of said prismatic piece, each core reel is sequentially positioned at said first station, then said second station, then said third station, and then back to said first station;

said machine further including:

means for rotatably driving said central piece through said steps;

means for rotatably driving each of said shafts in said second station;

means for cutting tape and fastening an end or tail to a rewound roll in said third station; and means for discharging a rewound roll and for charging a new core onto one of said core reels; and wherein said machine further includes a conveyor belt, said discharging and charging means being movable in a rectilinear direction, said discharging and charging means being made up of a puller/loader, said puller/loader including a front part and a rear portion, said front part including a fork seat for laterally engaging and unloading a roll, said rear portion including a seat for receiving and loading a new core onto one of said core reels, said machine further including an underlying basin for collecting unloading rolls and for supplying said rolls to said conveyor belt, said conveyor belt running under said basin, said machine further including a core feeding device and a sloping feeding channel, said core feeding device being operable to feed said cores through said sloping feeding channel; and said method comprising operating said discharging and charging means according to the following steps:

(a) travelling from an initial start position toward a roll to be unloaded, said travelling being along a sloping plane of said feeding channel so that said fork seat moves to a side of a roll on a core reel;

(b) travelling in a direction parallel to the axis of a core reel to extract a roll from said core reel and to cause the roll to fall toward said basin;

(c) travelling to bring a core in alignment with a core reel;

(d) travelling in a direction opposite to the direction of step (b) to introduce a new core onto a core reel, and finally, (e) travelling in the direction of step (b), so that the seat is disengaged from a core reel, after which the discharging and charging means is returned to said initial start position;

said travelling being driven by an hydraulic or pneumatic cylinder.

17. A method according to claim 16 wherein said discharging and charging means is assembled on a mobile support, said support having guides, and the travelling of steps (a) and (c) is obtainable by sliding said support along said guides, said machine including a rack and gears, said support having the same slope as said channel, means for performing said sliding, said performing means being under the control of an hydraulic or pneumatic cylinder through said rack and said gears, said machine including a third hydraulic or pneumatic cylinder, and wherein said travel in said steps (b), (d) and (e) is obtainable by sliding said support along said guides under the control of said third hydraulic or pneumatic cylinder, whereby said discharging and charging means can be moved away from said turret for inspection and maintenance of said machine.

* * * * *